United States Patent [19]

Watkin

[11] 4,418,958

[45] Dec. 6, 1983

[54] PLASTICS CHAIR SHELL

[76] Inventor: Bernard C. Watkin, 32 West Square, London SE11, England

[21] Appl. No.: 226,888

[22] Filed: Jan. 21, 1981

[30] Foreign Application Priority Data

Jan. 21, 1980 [GB] United Kingdom ..... 8001981

[51] Int. Cl.[3] ..... A47C 7/02

[52] U.S. Cl. ..... 297/457; 297/458; 297/460; 297/DIG. 2

[58] Field of Search ..... 297/460, 458, 459, DIG. 2, 297/452, 445, 457

[56] References Cited

U.S. PATENT DOCUMENTS

| | | | |
|---|---|---|---|
| D. 166,397 | 4/1952 | Komai | 297/457 X |
| 2,071,988 | 2/1937 | Sasse | 297/460 X |
| 2,127,710 | 8/1938 | Baker | 297/457 |
| 2,412,112 | 12/1946 | Wood et al. | 297/459 |
| 2,993,733 | 7/1961 | Pinkham | 297/445 |
| 3,014,762 | 12/1961 | Mauser | 297/445 |
| 3,034,830 | 5/1962 | Avedon | 297/445 |
| 3,111,344 | 11/1963 | Hoven et al. | 297/460 |
| 3,133,765 | 5/1964 | Kramer | 297/457 X |
| 3,201,172 | 8/1965 | Bliss | 297/457 |
| 3,756,656 | 9/1973 | Weick | 297/457 |
| 3,768,863 | 10/1973 | Jennings | 297/445 |
| 4,047,757 | 9/1977 | Eames et al. | 297/460 |

FOREIGN PATENT DOCUMENTS

| | | |
|---|---|---|
| 1192386 | 4/1959 | France . |
| 2314692 | 1/1977 | France . |

*Primary Examiner*—Francis K. Zugel

*Attorney, Agent, or Firm*—Kirschstein, Kirschstein, Ottinger & Cobrin

[57] ABSTRACT

A chair shell of resilient material such as polypropylene comprises a back support 12 and a seat portion 14. The natural deformability of the back support 12 is modified by slits 22, 24 and holes 32, 34, 36 so that under pressure from the back of a sitter resting against the back support the support is resiliently deformed into a shape which, in vertical section, includes a convex curve positioned properly to support the sitter's spine in the lumbar region and which is horizontal in convex section. The deformability of seat 14 can be modified by slits 42, 44 and holes 42, 46, 48, 50, 54 to provide softer rear and front zones 44 and 52 to reduce the pressure on the ischial tuberosities and lower thighs of the sitter. The chair shell provides comfortable and orthopaedically desirable support while avoiding the need for thick upholstery. The undeformed state of the chair shell may be designed to allow the chairs to be easily stacked.

11 Claims, 3 Drawing Figures

PLASTICS CHAIR SHELL

Figure 1:
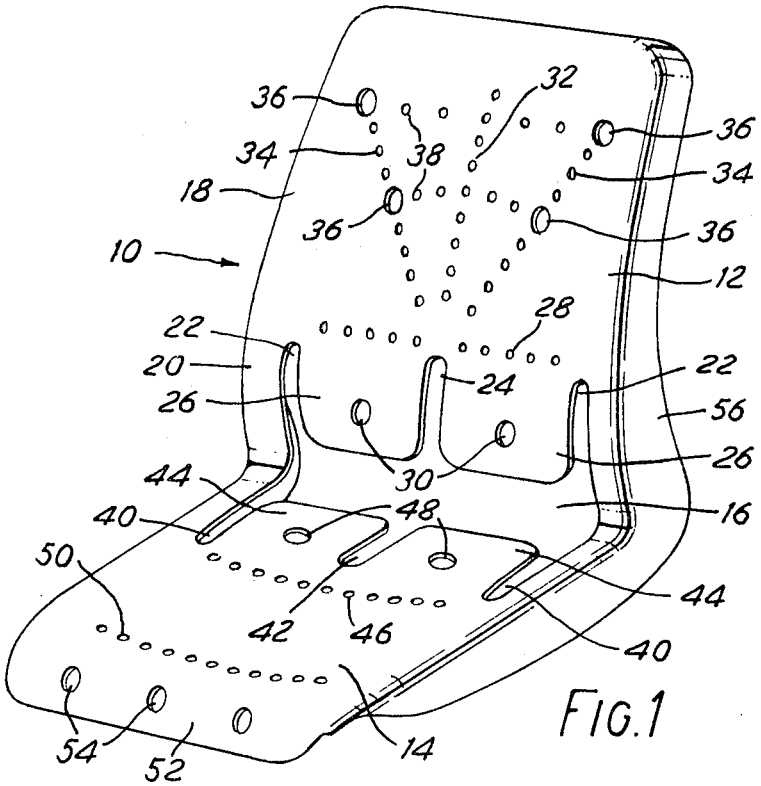

This invention relates to chair shells.

It is desirable that a chair should be shaped to provide support for the spine and thighs of someone sitting on the chair so that the spine is supported in the orthopaedically preferred position. This position is described in British patent specification No. 1,294,091 and in the brochure "S Range" published in the United Kingdom by Arenson International Limited of St. Albans. Ideally, the sitter's spine should be supported in an approximately vertical elongate "S" shape whose curves define a plane transverse to the back support of the chair, the lower curve being concave to the back support and being defined by the lumbar and lower thoracic vertebrae while the upper curve is convex and is defined by the upper thoracic and cervical vertebrae. The "S" shape results in less pressure on the chest and contents of the abdomen and so improves breathing, cardiac function and digestion. It also reduces strain on the muscles, ligaments and bones of the spine and pelvis so that less restlessness occurs as a result of the sitter instinctively trying to correct bad posture. The "S" shape also gives a better pressure distribution over the skin, and reduces pressure on the intervertebral discs, lessening the risk of causing or aggravating disc disorders. It is also desirable to give support to the lateral regions of the sitter's back on either side of the spine by using a back support which is concave in horizontal section, as described in British patent specification No. 1,294,091.

It is also desirable that pressure on the ischial tuberosities of the sitter be reduced. Support of the spine in the "S" shape achieves this to some extent by transferring some of the load on the ischial tuberosities to the underside of the thighs. It is also desirable, particularly with such a transfer of load to the thighs, to avoid compression of blood vessels and nerves which pass through the popliteal space, and this can be achieved by using a seat pan which dips toward the front, as described in the above-mentioned brochure.

In upholstered chairs, the chair shell can be covered with upholstery of a shape and compressibility suitable for biassing a sitter into the orthopaedically desirable positions. This is not possible in a non-upholstered or lightly upholstered chair. It would be possible to make a rigid chair with the back rest formed to include a lumbar support in the shape defined in the above-mentioned patent specification 1,294,091, but such a chair would only be suitable for a limited range of people, since the surface of the chair would not be capable of taking up the albeit relatively small changes of shape necessary to provide the desirable support to people of different sizes. Moreover, in the case of stackable chairs, it has been found that stable stacking is only possible if the chair shells approximate closely to an "L" shape and this precludes detailed contouring of the shell to any great degree.

This invention consists in a chair shell of resilient material comprising a back support and a seat portion in which the deformability of the back support is locally modified so that under pressure from the back of a sitter resting against the back support the back support is resiliently deformed into a shape which, in vertical section, includes a convex curve positioned to support the sitter's spine in a convex curve in the lumbo-sacral region and which is concave in horizontal section.

The deformability of the chair may be modified by providing zones of weakness in the material of the shell. It has been found that by suitably arranging such zones of weakness the chair shell is enabled to deform resiliently into a comfort including shape under the pressure of a sitter. It has further been found that the deformability of crystalline homopolymers of propylene and of similar copolymers of propylene permits an accurate gradation in deformation which is virtually totally recoverable when the sitter stands up and which shows little if any deterioration with length of service of the chair provided the polypropylene is not subjected to excessive oxidative degradation.

Accordingly, the chair shell of the invention is preferably moulded from a crystalline propylene polymer which may be a homopolymer or a copolymer with up to about 18% (by weight of the copolymer) of ethylene, especially sequential copolymers made by injecting ethylene into the latter stages of an otherwise homopolymerisation of propylene. The propylene polymers may be blended with, for example, up to 20% (by weight of the blend) of a rubber, preferably an optionally diene-modified random copolymer of ethylene and propylene. The resilience of crystalline propylene polymers enables controlled deformation of the chair shells when the sitter sits down followed by almost immediate recovery when the sitter stands up. So, for example in making stackable chairs, by choosing propylene polymers, the chair shells can be moulded in the approximate "L" shape needed for stable stacking yet they can be controllably deformed to provide comfort inducing support and then they can recover their "L" shape for stacking.

Advantageously, the back support of the chair shell has upper and lower zones of weakness which under pressure from the back of a sitter resting against the back support enable the back support to deform into the said convex curve, and into the curve concave in horizontal section, and the seat portion is provided with a rear zone of weakness enabling the seat portion to be deformed backwards under pressure from the ischial tuberosities of a sitter. The rear zone of weakness in the seat portion provides a reduction in pressure on the ischial tuberosities, in addition to that resulting from the support given to the spine, as discussed above. To reduce pressure on the blood vessels and nerves passing through the popliteal spaces of a sitter, the front of the seat portion is preferably provided with a zone of weakness or is shaped to dip away from the thighs of a sitter.

The zones of weakness may be provided by, for example, open or blind holes, or grooves or slits formed in the chair shell or by reducing the thickness of the thermoplastics material in the zone. Holes or slits may be made in predetermined shapes which assist the deformation of the shell into the appropriate shape. Alternatively, the zones of weakness may be provided by increasing the rigidity of other parts of the chair shell, for example by reinforcing the other parts by ribs. The precise amounts of weakening will depend on the rigidity of the particular thermoplastics material chosen and on the dimensions of the chair shell.

The back support may be extended upwards to provide a neck and/or head support. The head support may be provided with localised weakening to assist in the conformation to the contours of the neck and head. When the chair is in the form of a vehicle seat the weakening can be arranged to prevent the resiliency of the head-rest portion of the seat from contributing to "whiplash" injury to the neck of the sitter.

Figure 3:
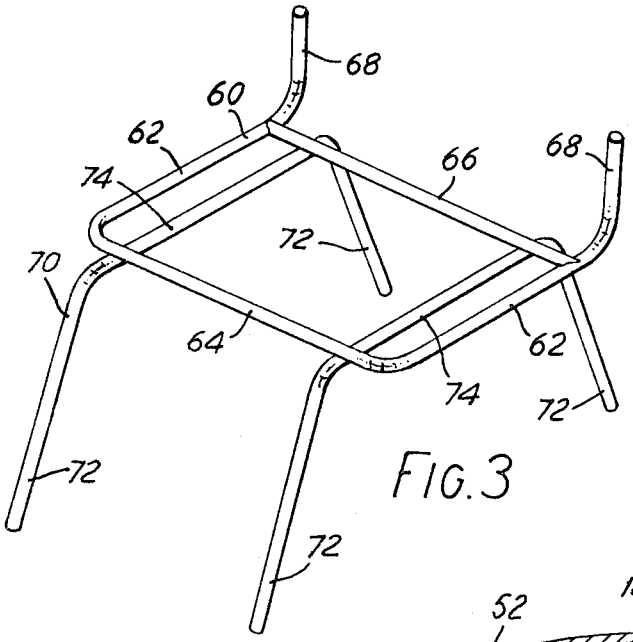
Figure 2:
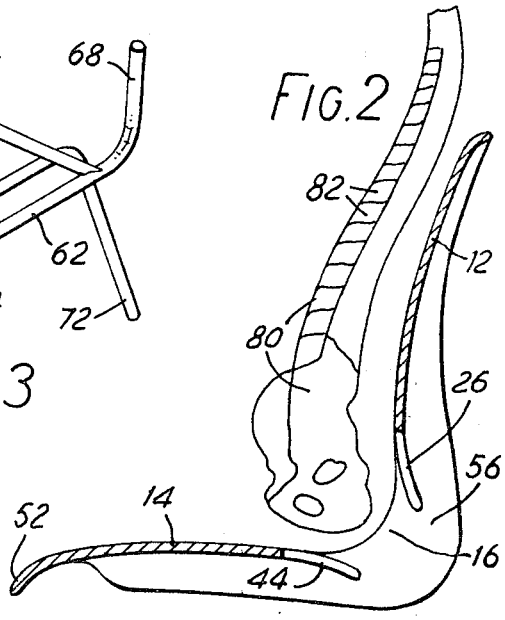
Figure 1:
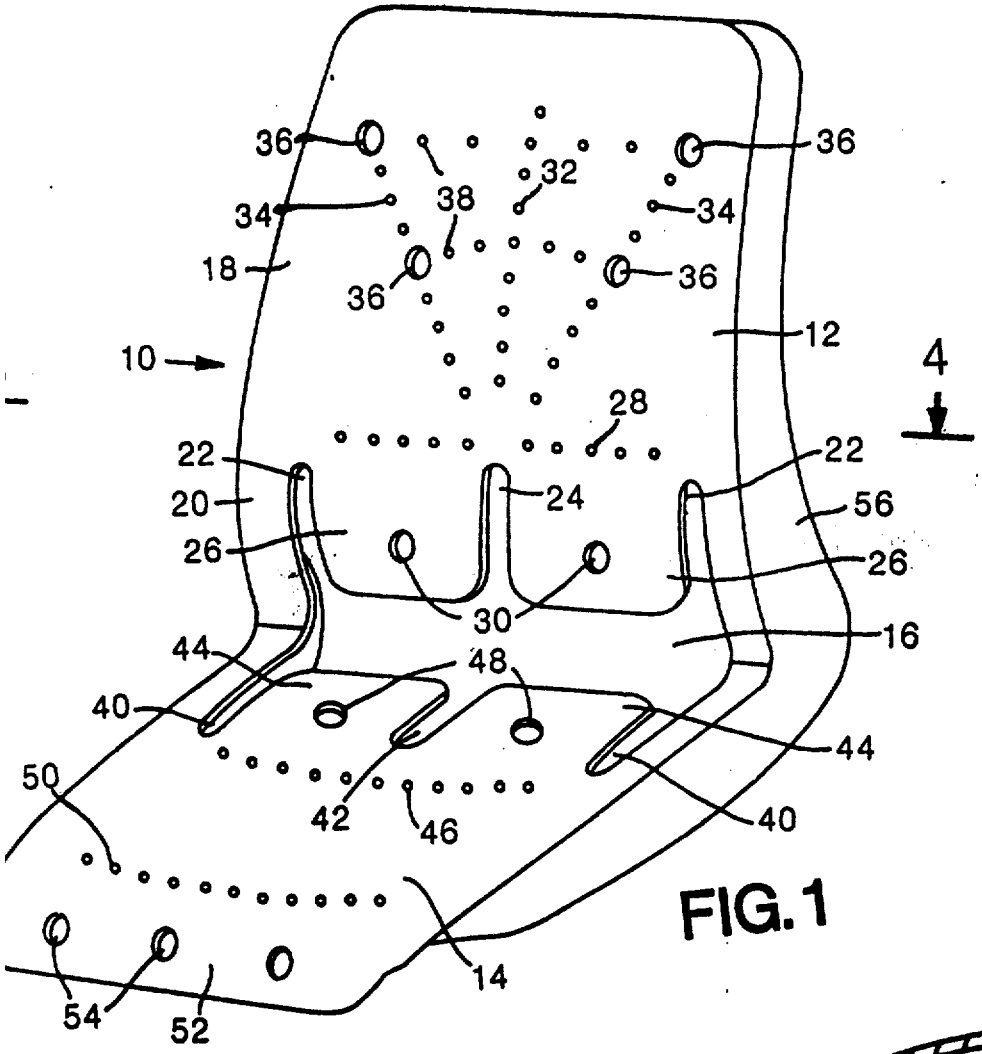
Figure 4:
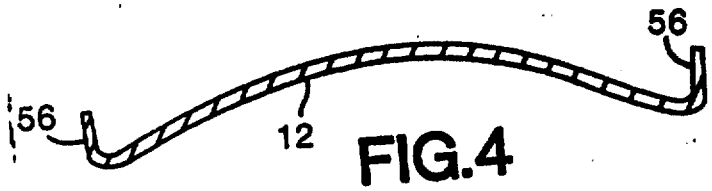

The invention will now be described, by way of example, with reference to the drawings of which:

FIG. 1 shows a perspective view of a chair shell in accordance with the invention, FIG. 2 shows a central vertical transverse section of the shell shown in FIG. 1 and a side elevation of a spine in the orthopadically preferred position for sitting, FIG. 3 shows a frame to which the chair shell may be fixed, and FIG. 4 is a section on the line 4—4 of FIG. 1.

Referring to the drawings, a polypropylene chair shell 10 consists of a back support 12 and a seat 14. The back support 10 and seat 12 define an "L"-shape suitable for use in a stackable chair. The back support 12 is slightly concave in horizontal section and in vertical section has a lower portion 20 which is substantially perpendicular to the seat 14 and an upper portion 18 which curves backwards. The seat 14 is slightly concave in a section taken on a line extending from side to side of the chair shell and in a section taken on a line extending from front to rear is substantially flat apart from a downwardly curved front portion 52. At the junction of the back support 12 and seat 14 the chair shell is formed with an aperture 16 which extends almost to the lateral edges of the back support 12 and seat 14.

The natural deformability of the back support 12 is modified in such a manner that when a person sits on the seat the back support 12 is deformed into a shape more closely approximating to the preferred shape discussed above. To this end, the lower part 20 of the back support 12 is formed with two slits 22 extending upwards from the aperture 16 near the lateral edges of the back support and a third slit 24 extending upwards from the aperture 16 and positioned centrally between the slits 22. The two portions 26 of the back support 12 between the central slit 24 and the respective side slits 22 can flex backwards, and their flexibility is enhanced by a line of weakness provided by a series of small holes 28 extending horizontally above the slits 22 and 24. A larger diameter hole 30 in each of the portions 26 increases the softness of each portion.

In the upper portion 18 of the back support 12 a central line of holes 32 extends upwards from a point above the central slit 24. On each side of the holes 32 is a line of holes 34 extending diagonally from a point near the top of central slit 24 to a point near one upper corner of the back support 12. Each line of holes 34 includes in its upper half two larger diameter holes 36 which increase the flexibility of the upper part of the back support 12. Additional, horizontally extending lines of holes 38 may be provided to increase the flexibility of the upper part of the back support.

The seat 14 similarly has its deformability modified. The flexibility of the rear part of the seat 14 is increased by two slits 40 and a centrally disposed slit 42 each extending forwards from the aperture 16 to define two portions 44 which can flex downwards. A row of holes 46 extending from side to side of the seat 14 in front of the slits 40 and 42 provides a line of weakness which increases the downward flexure of the portions 44 under the weight of a person sitting on the seat. A hole 48 in each portion 44 increases the softness of the portions and also decreases the pressure in use on the ischial tuberosities of the sitter.

A further line of holes 50 near the front of the seat 14 enables the front portion 52 of the seat to flex downwards. Larger-diameter holes 54 increase the softness of the front portion 52.

A strengthening flange 56 extends continuously around the side and top edges of the back support 12 and along the side edges of the seat 14. The flange 56 stops short of the front portion 52 of the seat 14, so as not to affect the flexibility of that portion. The flange 56 strengthens the chair shell, which might otherwise be unduly weakened by the various apertures formed in it. The strength of the chair shell at the junction of the back support 12 and seat 14 may be further strengthened by a supporting frame, as described below.

In use, when a person sits on the chair shell and rests his back against the back support 12, the pressure of the lower part of the user's back causes the portions 26 of the back support 12 to flex backwards, so that the lower part of the back support is deformed to a shape which is convex in vertical section. At the same time, the centre of the back support is moved backwards, the inner edge portions 26 being pushed backwards further than their outer edges, so that the concavity of the back support in horizontal section is increased, to provide "wrap-around" support to the back of the user to tend to hold it in the correct position. The two portions 26 can move to some extent independently of one another, so that the back support tends to assume the correct shape even if the user's back moves to one side or other of a central position. The apertures 32, 34, 36 in the upper part 18 of the back support 12 modify its deformability so that, under pressure of the user's back, the upper part 18 tends to be deformed backwards to increase the convexity of the back support in vertical section and at the same time tends to increase its concavity in horizontal section.

The weight of the sitter's body deforms the portions 44 of the seat 14 downwardly to accommodate the ischial tuberosities. The portions 44 can move independently of one another, so that one portion can be pressed down more than the other if the sitter positions his body so that more of its weight is supported on that one portion. The front portion 52 is also deformed downwardly, so that the front of the seat dips away from the thighs, reducing pressure on the nerves and blood vessels coming through the popliteal space. The downward deformation of the rear and front portions of the seat 14 also tends to cause the middle portion of the seat, between the lines of holes 46 and 60 to bow upwards, so that the seat adopts, in front-to-rear section, an upwardly convex curve which is desirable in providing support for the thighs. Since, as mentioned above, the support of the spine in the S-shape alters the distribution of pressure exerted on the seat, it is important to design the deformability of seat 14 in conjunction with that of the back support 12 to give the correct interrelationship between the two.

The chair shell is thus deformed to a shape approximating to the ideal shape which supports the spine, particularly the lumbar vertebrae 80 and lower thoracic vertebrae 82, in the orthopaedically preferred concave curve, and at the same time properly supports the thighs and pelvis. The resilience provided by the increased deformability, particularly of the portions 26 in the lower part of the back support 12 and the portions 44 at the rear of the seat 14, increase the comfort of the chair shell without the need for thick upholstery.

When the sitter stands up, the deformed polypropylene chair shell recovers its original shape almost instantaneously, so that the chair is ready for immediate stacking. The undeformed shape of the chair shell is such that the shells can be easily stacked.

It will be appreciated that the chair shell must be provided with a suitable supporting structure, which may take the form of a tubular metal frame 60 as shown in FIG. 3. It is important that the supporting structure does not adversely interfere with the deformation of the shell under the weight of the user. The frame 60 has two side members 62 which are positioned at the sides of the seat 14, adjacent the flange 56, joined by front and rear members 64 and 66. The front member is positioned to the rear of the front portion 52 of the seat 14 so as not to interfere with the flexible movement of the part 52. The rear member 66 is positioned in the aperture 16 of the chair shell 10. The two side members 62 extend rearwardly of the rear member 66 and curve upwards to form upright members 68, which extend partway up the back support 12 of the chair shell. The portions 68 strengthen the chair shell at the junction of the back support 12 and seat 14 and prevent excessive movement between the two. The frame includes two leg members 70, each consisting of two legs 72 joined by a cross-member 74 welded to the front and rear members 64 and 66. The cross-members 74 are thus positioned below the members 64 and 66 and so are separated from the seat 14 and do not interfere with its deformation. The chair shell 10 may be fixed by any suitable means to the frame 60, for example by bolts or rivets passing through holes in the shell and in the side members 62 of the frame.

It will be appreciated that the arrangement of holes in the chair shell could take different forms. The precise shape, dimensions and positions of the holes will depend on the thickness and normal flexibility of the material of the chair shell. As mentioned above, instead of holes, the weaknesses in the shell could be formed by other means, such as grooves or recesses formed in the rear surface of the chair shell.

In addition to the stackable chair described, the invention could be applied to other non-upholstered furniture, such as garden furniture, and also to lightly upholstered furniture. The invention could for example be applied to aircraft seats, with the advantage of reducing the amount of upholstery required as compared with conventional aircraft seats, and therefore reducing the amount of inflammable material in the seat. The same advantage could be obtained in domestic furniture using the shell of the invention with a thin covering of foam upholstery. A chair could, for example, be provided with false sides to give the chair the same appearance as a conventionally upholstered chair. The invention could also be applied to seats of width large enough to accommodate two or more people, for example to settees or bench seats. In that case, the shape and distribution of the zones of weakness would need to be arranged so that the part of the seat on which the user sat would deform to the appropriate shape irrespective of the precise location of the sitter and of the effects of the weight of another person at a different location on the seat. The back support and the seat could be made separately and joined together by a suitable locking hinge, so that the chair shell could be employed, with a suitable supporting structure, in a seat with a folding back or seat portion, for example a theatre seat or vehicle seat.

It will be appreciated that the shape of the chair shell could be different from that of the described embodiment. For example, the back support and the seat could be completely flat in the undeformed shape, without the initial slight curvatures of the described embodiments. The shape could be altered to suit other applications of the invention, as mentioned above. For example, the angle between the back support and the seat could be altered to suit the use to which the chair shell is to be put.

I claim:

1. A chair shell of resilient material comprising a back support and a seat, in which:

an aperture is formed in the chair shell at the junction of the back support and the seat, the opening extending almost to the lateral edges of the chair shell, the back support has an upper portion and a lower portion, the upper portion of the back support has zones of weakness arranged to modify the deformability of the back support so that when the back support is flexed under pressure from the back of a sitter the said upper part is deformed to a shape which is forwardly convex in vertical section and forwardly concave in horizontal section, the lower portion of the back support is divided into two portions by a centrally disposed slit which extends upwards from the said aperture, the two portions being adapted to flex under pressure from the back of a sitter in such a manner that the lower edges of the said portions move backwards to increase the convexity of the back support in vertical section and the inner edges of the said portions move backwards to increase the concavity of the back support in horizontal section, the said seat has a rear portion, a middle portion and a front portion, said rear portion of the seat being constructed to be deformed resiliently backwards under pressure from the ischial tuberosities of the sitter, said front portion of the seat being constructed to be resiliently deformed downwards under pressure from the under-thighs of the sitter.

2. A chair shell as claimed in claim 1, in which the said rear portion of the seat is divided into two independently movable portions by a slit extending forwards from the said aperture at the junction of the seat and the back support.

3. A chair shell as claimed in claim 2, in which each of the two independently movable portions of the seat is formed with an aperture positioned to relieve pressure on the ischial tuberosities of the sitter.

4. A chair shell as claimed in claim 1, in which each of the said two portions of the lower portion of the back support is formed with an aperture to increase the softness of said portion.

5. A chair shell as claimed in claim 1, in which the lower portion of the back support is formed with slits extending upwardly from the said opening and positioned on either side of the central slit near the sides of the back support.

6. A chair shell as claimed in claim 5, in which a line of weakness is formed in the back support which extends horizontally across the back support in the region of the upper ends of the said slits.

7. A chair shell as claimed in claim 1, in which the upper portion of the back support is formed with two lines of weakness extending from a point near the centre of the back support to points near the upper right and left corners respectively of the back support.

8. A chair shell as claimed in claim 1, in which the back support in its undeformed state has a shape which is convex in vertical section and concave in horizontal section and the deformability of the back support is locally modified so that under pressure from the back of a sitter the back support is resiliently deformed so as to increase the said convexity and concavity respectively.

9. A chair shell as claimed in claim 1, in which the deformability of the back support is modified by lines of weakness including lines of holes formed in the back support.

10. A chair shell as claimed in claim 1, in which the material of the chair shell is a crystalline propylene polymer.

11. A chair shell as claimed in claim 10, in which the material is a homopolymer or copolymer of propylene with up to 18% by weight of ethylene.

* * * * *

UNITED STATES PATENT AND TRADEMARK OFFICE

CERTIFICATE OF CORRECTION

PATENT NO. : 4,418,958

DATED : December 6, 1983

INVENTOR(S) : Bernard C. Watkin

It is certified that error appears in the above-identified patent and that said Letters Patent is hereby corrected as shown below:

The title page should be deleted to appear as per attached title page.

Figures 1 and 4 of the drawing should appear as shown on the attached sheet

On the title page, "3 Drawing Figures" should read -- 4 Drawing Figures --.

Signed and Sealed this

Ninth Day of October 1984

[SEAL]

Attest:

GERALD J. MOSSINGHOFF

Attesting Officer

Commissioner of Patents and Trademarks

'nited States Patent [19]
atkin

[11] 4,418,958
[45] Dec. 6, 1983

] PLASTICS CHAIR SHELL

] Inventor: Bernard C. Watkin, 32 West Square, London SE11, England

] Appl. No.: 226,888

] Filed: Jan. 21, 1981

] Foreign Application Priority Data

Jan. 21, 1980 [GB] United Kingdom ..... 8001981

] Int. Cl.³ ..... A47C 7/02
] U.S. Cl. ..... 297/457; 297/458; 297/460; 297/DIG. 2
] Field of Search ..... 297/460, 458, 459, DIG. 2, 297/452, 445, 457

6] References Cited

U.S. PATENT DOCUMENTS

| | | | |
|---|---|---|---|
| D. 166,397 | 4/1952 | Komai | 297/457 X |
| 2,071,988 | 2/1937 | Sasse | 297/460 X |
| 2,127,710 | 8/1938 | Baker | 297/457 |
| 2,412,112 | 12/1946 | Wood et al. | 297/459 |
| 2,993,733 | 7/1961 | Pinkham | 297/445 |
| 3,014,762 | 12/1961 | Mauser | 297/445 |
| 3,034,830 | 5/1962 | Avedon | 297/445 |
| 3,111,344 | 11/1963 | Hoven et al. | 297/460 |
| 3,133,765 | 5/1964 | Kramer | 297/457 X |
| 3,201,172 | 8/1965 | Bliss | 297/457 |
| 3,756,656 | 9/1973 | Weick | 297/457 |
| 3,768,863 | 10/1973 | Jennings | 297/445 |
| 4,047,757 | 9/1977 | Eames et al. | 297/460 |

FOREIGN PATENT DOCUMENTS

| | | |
|---|---|---|
| 1192386 | 4/1959 | France . |
| 2314692 | 1/1977 | France . |

*Primary Examiner*—Francis K. Zugel
*Attorney, Agent, or Firm*—Kirschstein, Kirschstein, Ottinger & Cobrin

[57] ABSTRACT

A chair shell of resilient material such as polypropylene comprises a back support 12 and a seat portion 14. The natural deformability of the back support 12 is modified by slits 22, 24 and holes 32, 34, 36 so that under pressure from the back of a sitter resting against the back support the support is resiliently deformed into a shape which, in vertical section, includes a convex curve positioned properly to support the sitter's spine in the lumbar region and which is horizontal in convex section. The deformability of seat 14 can be modified by slits 42, 44 and holes 42, 46, 48, 50, 54 to provide softer rear and front zones 44 and 52 to reduce the pressure on the ischial tuberosities and lower thighs of the sitter. The chair shell provides comfortable and orthopaedically desirable support while avoiding the need for thick upholstery. The undeformed state of the chair shell may be designed to allow the chairs to be easily stacked.

11 Claims, 3 Drawing Figures

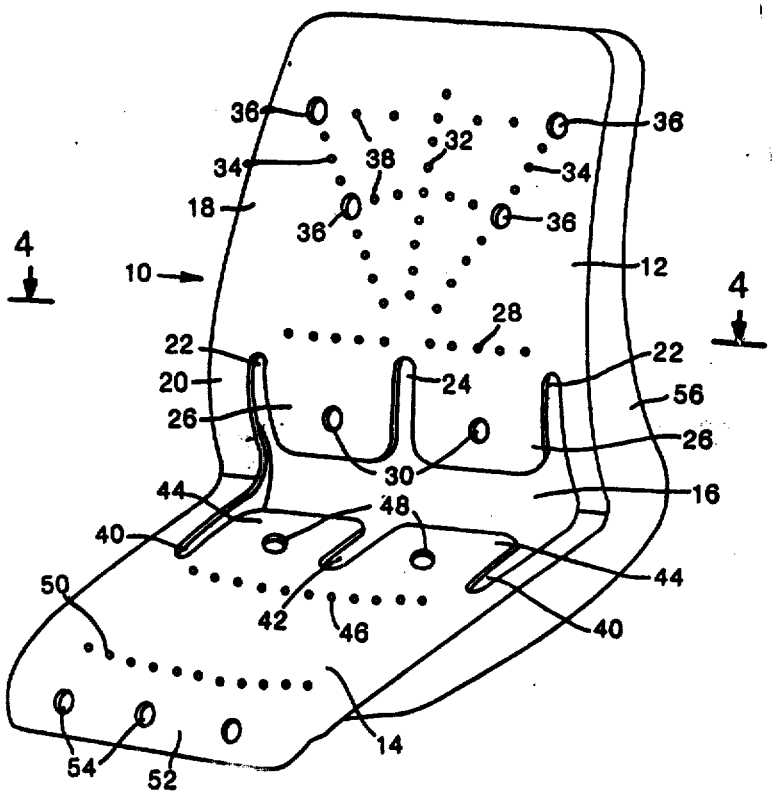

Patent No. 4,418,958 December 6, 1983

Bernard C. Watkin